US012274305B2

(12) United States Patent
Wright

(10) Patent No.: US 12,274,305 B2
(45) Date of Patent: Apr. 15, 2025

(54) AEROSOL PROVISION DEVICE

(71) Applicant: Nicoventures Trading Limited, London (GB)

(72) Inventor: Jeremy Wright, London (GB)

(73) Assignee: NICOVENTURES TRADING LIMITED, London (GB)

( * ) Notice: Subject to any disclaimer, the term of this patent is extended or adjusted under 35 U.S.C. 154(b) by 900 days.

(21) Appl. No.: 17/309,043

(22) PCT Filed: Oct. 16, 2019

(86) PCT No.: PCT/GB2019/052944
§ 371 (c)(1),
(2) Date: Apr. 16, 2021

(87) PCT Pub. No.: WO2020/079426
PCT Pub. Date: Apr. 23, 2020

(65) Prior Publication Data

US 2021/0337875 A1 Nov. 4, 2021

(30) Foreign Application Priority Data

Oct. 16, 2018 (GB) ..... 1816831

(51) Int. Cl.
*A24F 40/485* (2020.01)
*A24F 40/10* (2020.01)

(52) U.S. Cl.
CPC ..... *A24F 40/485* (2020.01); *A24F 40/10* (2020.01)

(58) Field of Classification Search
CPC ..... A24F 40/485
See application file for complete search history.

(56) References Cited

U.S. PATENT DOCUMENTS

| | | | | |
|---|---|---|---|---|
| 2014/0166029 | A1 | 6/2014 | Weigensberg et al. | |
| 2015/0150305 | A1 | 6/2015 | Shenkal | |
| 2016/0270446 | A1 | 9/2016 | Shenkal et al. | |
| 2017/0196268 | A1* | 7/2017 | Reevell | A24F 40/49 |
| 2018/0168236 | A1 | 6/2018 | Qiu | |
| 2020/0221777 | A1* | 7/2020 | Saygili | A24F 40/57 |
| 2021/0045448 | A1 | 2/2021 | Yamada et al. | |

FOREIGN PATENT DOCUMENTS

| | | | |
|---|---|---|---|
| CA | 3097715 | A1 | 11/2017 |
| CA | 3097879 | A1 | 11/2017 |
| CN | 107427077 | A | 12/2017 |
| CN | 107536100 | A | 1/2018 |
| CN | 108430244 | A | 8/2018 |
| EP | 3689162 | A1 | 8/2020 |

(Continued)

OTHER PUBLICATIONS

European Search Report, European Application No. GB1816831.0, mailing date Feb. 20, 2019, 3 pages.

(Continued)

*Primary Examiner* — Cynthia Szewczyk
(74) *Attorney, Agent, or Firm* — Husch Blackwell

(57) ABSTRACT

An electronic aerosol provision device, the device comprising a housing for receipt of an aerosol generating component, the housing comprising an air inlet and an aerosol outlet, wherein the device is configured to induce a reduction in the temperature of an aerosol when exiting the air inlet.

19 Claims, 10 Drawing Sheets

(56) References Cited

FOREIGN PATENT DOCUMENTS

| | | | |
|---|---|---|---|
| JP | S544787 | U | 1/1979 |
| JP | 2008535530 | A | 9/2008 |
| JP | 2013524835 | A | 6/2013 |
| JP | 2017225357 | A | 12/2017 |
| KR | 20180043341 | A | 4/2018 |
| RU | 2588456 | C2 | 6/2016 |
| RU | 2608689 | C1 | 1/2017 |
| RU | 2608915 | C2 | 1/2017 |
| WO | 2006082571 | A1 | 8/2006 |
| WO | 2007098337 | A2 | 8/2007 |
| WO | 2011137453 | A2 | 11/2011 |
| WO | WO2013083635 | A1 | 6/2013 |
| WO | WO2015062136 | A1 | 5/2015 |
| WO | WO2016058139 | A1 | 4/2016 |
| WO | 2017051150 | A1 | 3/2017 |
| WO | WO2017153579 | A1 | 9/2017 |
| WO | 2017216516 | A1 | 12/2017 |
| WO | 2018007627 | A1 | 1/2018 |
| WO | 2018114261 | A1 | 6/2018 |
| WO | WO2018234792 | A1 | 12/2018 |
| WO | 2019208536 | A1 | 10/2019 |

OTHER PUBLICATIONS

Written Opinion, International Application No. PCT/GB2019/052944, mailing date Sep. 4, 2020, 6 pages.

International Search Report and Written Opinion, International Application No. PCT/GB2019/052944, mailing date Jan. 28, 2020, 13 pages.

International Preliminary Report on Patentability, International Application No. PCT/GB2019/052944, mailing date Jan. 26, 2021, 7 pages.

"Office Action received for Chinese Patent Application No. 201980068279.8, mailed on Apr. 12, 2023", 12 pages (6 Pages of English Translation and 6 pages of Official Copy).

"Reasons for Rejection received for Japanese Patent Application No. 2021-521039, mailed on May 31, 2022", 6 pages (03 pages of English Translation and 03 pages of Official Copy Only).

"Search Report received for Japanese Patent Application No. 2021-521039, mailed on May 27, 2022", 21 pages (13 pages of English Translation and 08 pages of Official Copy Only).

"Search Report received for Russian Patent Application No. 2021110575, mailed on Jan. 18, 2022", 2 pages.

* cited by examiner

AEROSOL PROVISION DEVICE

CROSS-REFERENCE TO RELATED APPLICATION

The present application is a National Phase entry of PCT Application No. PCT/GB2019/052944, filed Oct. 16, 2019, which claims priority from Great Britain Patent Application No. 1816831.0, filed Oct. 16, 2018, which is hereby fully incorporated herein by reference.

TECHNICAL FIELD

The present disclosure relates to an electronic aerosol provision device and electronic aerosol provision system comprising the device.

BACKGROUND

Electronic aerosol provision systems, such as e-cigarettes, which generate an aerosol for a user to inhale are well known in the art. Such systems are generally battery powered and contain an aerosol provision device comprising the battery and an aerosol provision component which may be engaged with the device so as to generate the aerosol. The aerosol can be generated in a variety of ways. For example, the aerosol may be generated by heating a substrate to form a vapor which subsequently condenses in passing air so to form a condensation aerosol. Alternatively, the aerosol might be generated by mechanical means, vibration etc. so that the substrate becomes dispersed in passing air so as to form an aerosol.

As various types of aerosol provision systems become more popular, there is a need to ensure that they are ergonomically acceptable to consumers. For example, consumers generally prefer systems that are more compact since it means they can be easily held. Further, storage of such compact systems is generally easier. However, the present inventors have found that certain problems can result from developing compact aerosol provision systems.

SUMMARY

In one aspect of the present disclosure there is provided an electronic aerosol provision device, the device comprising a housing for receipt of an aerosol generating component, the housing comprising an air inlet and an aerosol outlet, wherein the device is configured to induce a reduction in the temperature of an aerosol when exiting the air inlet.

In a further aspect of the present disclosure there is provided an electronic aerosol provision device, the device comprising a housing for receipt of an aerosol generating component, the housing comprising an air inlet and an aerosol outlet, wherein an uninterrupted linear pathway exists between the air inlet and the aerosol outlet.

In a further aspect of the present disclosure there is provided an electronic aerosol provision device, the device comprising a housing for receipt of an aerosol generating component, the housing comprising an air inlet and an aerosol outlet, wherein the air inlet comprises an aperture with at least one fixed obstruction which extends at least partially across the aperture without fully preventing airflow through the aperture.

In a further aspect of the present disclosure there is provided an electronic aerosol provision device, the device comprising a housing for receipt of an aerosol generating component, the housing comprising an air inlet and an aerosol outlet, wherein the air inlet is at distal end of the device housing and the aerosol outlet is at a proximal end of the device housing, wherein a ratio of from 1:2 to 1:1 exists between the length of the flow path between the air inlet and the aerosol outlet, and the total length of the device.

In an embodiment of any of the above aspects, an uninterrupted linear pathway exists between the air inlet and the aerosol outlet.

In an embodiment of any of the above aspects, a chamber for receiving an aerosol generating component is formed in the pathway between the air inlet and the aerosol outlet.

In an embodiment of any of the above aspects, the aerosol outlet forms part of a mouthpiece.

In an embodiment of any of the above aspects, the air inlet comprises an aperture with at least one fixed obstruction which extends at least partially across the aperture without fully preventing airflow through the aperture.

In an embodiment of any of the above aspects, the at least one fixed obstruction extends from a point of attachment on an edge of the aperture.

In an embodiment of any of the above aspects, the at least one fixed obstruction extends from a point of attachment on an edge of the aperture to another point of attachment on the edge of the aperture.

In an embodiment of any of the above aspects, the number of points of attachment of the at least one fixed obstruction is represented by Pn, where n is selected from 1, 2, 3, 4, 5, 6 or more.

In an embodiment of any of the above aspects, there is a single fixed obstruction.

In an embodiment of any of the above aspects, the device is configured to reduce the temperature of the aerosol exiting the air inlet by about 5° C. or more, about 10° C. or more, about 15° C. or more, about 20° C. or more, about 25° C. or more, about 30° C. or more, about 35° C. or more, about 40° C. or more, about 45° C. or more, or about 50° C. or more.

In an embodiment of any of the above aspects, the device is configured to reduce the temperature of the aerosol exiting the air inlet to below about 140° C., below about 135° C., below about 130° C., below about 125° C., below about 120° C., below about 125° C., below about 120° C., below about 115° C., below about 110° C., below about 105° C., below about 100° C., below about 95° C., below about 90° C., below about 85° C., or below about 80° C.

In an embodiment of any of the above aspects, the air inlet is at distal end of the device housing and the aerosol outlet is at a proximal end of the device housing, wherein a ratio of from about 1:2 to about 1:1 exists between the length of the flow path between the air inlet and the aerosol outlet, and the total length of the device. The ratio may be from about 1:2 to 1:1, from about 2:3 to 1:1, from about 3:4 to 1:1, or from about 4:5 to 1:1

In a further aspect there is also provided an electronic aerosol provision system comprising the electronic aerosol provision device as described herein and an aerosol generating component.

In an embodiment of any of the above aspects, the aerosol generating component comprises an aerosol generating substrate.

In an embodiment of any of the above aspects, the substrate is a liquid.

In an embodiment of any of the above aspects, the substrate comprises a solid, such as tobacco.

In an embodiment of any of the above aspects, the aerosol generating component comprises an air inlet and an aerosol outlet.

In an embodiment of any of the above aspects, the aerosol generating component is located between the air inlet and the aerosol outlet of the device.

In an embodiment of any of the above aspects, the air inlet of the aerosol generating component connects with the air inlet on the device and the aerosol outlet aerosol generating component connects with the aerosol outlet on the device to provide an uninterrupted linear pathway between the air inlet and the aerosol outlet of the system.

In an embodiment of any of the above aspects, the aerosol generating cartridge is engaged to the aerosol outlet of the device.

In an embodiment of any of the above aspects, the air inlet of the aerosol generating component connects with the aerosol outlet on the device such that the aerosol outlet of the aerosol generating component serves to function as the aerosol outlet for the system, so as to provide the presence of an uninterrupted linear pathway between the air inlet and the aerosol outlet of the system.

In another aspect there is provided a method of reducing the temperature of an aerosol exiting an air inlet of an aerosol provision device, the method comprising using a fixed obstruction extending at least partially across the air inlet to reduce the temperature of the aerosol passing through the air inlet.

In another aspect of the present disclosure there is provided an electronic aerosol provision device, the device comprising a housing for receipt of an aerosol generating component, the housing comprising an air inlet and an aerosol outlet, wherein the device is configured to induce a reduction in the temperature of an aerosol when exiting the air inlet, the device comprising a temperature reduction means at, or in proximity to, the air inlet.

These and other aspects as apparent from the following description form part of the present disclosure. It is expressly noted that a description of one aspect may be combined with one or more other aspects, and the description is not to be viewed as being a set of discrete paragraphs which cannot be combined with one another.

DETAILED DESCRIPTION OF THE DRAWINGS

Aspects and features of certain examples and embodiments are discussed/described herein. Some aspects and features of certain examples and embodiments may be implemented conventionally and these are not discussed/described in detail in the interests of brevity. It will thus be appreciated that aspects and features of apparatus and methods discussed herein which are not described in detail may be implemented in accordance with any conventional techniques for implementing such aspects and features.

As described above, the present disclosure relates to an aerosol provision system, such as an e-cigarette. Throughout the following description the term "e-cigarette" is sometimes used but this term may be used interchangeably with aerosol (vapor) provision system. Furthermore, an aerosol provision system may include systems which are intended to generate aerosols from liquid source materials, solid source materials and/or semi-solid source materials, e.g. gels. Certain embodiments of the disclosure are described herein in connection with some example e-cigarette configurations (e.g. in terms of a specific overall appearance and underlying vapor generation technology). However, it will be appreciated the same principles can equally be applied for aerosol delivery systems having different overall configurations (e.g. having a different overall appearance, structure and/or vapor generation technology).

Figure 1:
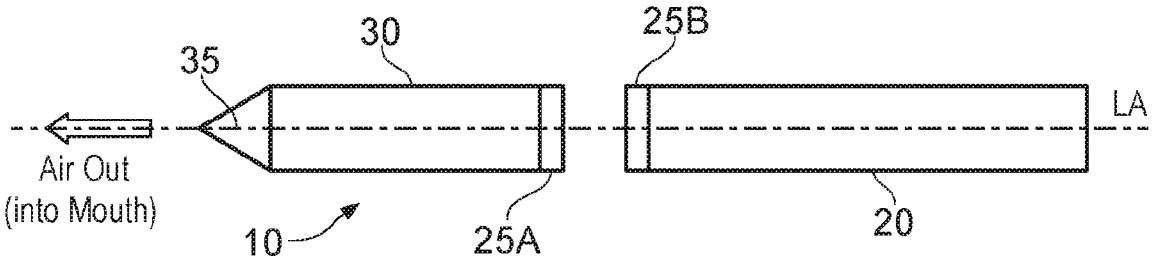
FIG. 1 is a schematic representation of an aerosol provision device according to the prior art.

FIG. 1 is a schematic diagram of an aerosol/vapor provision system of the prior art (not to scale). The e-cigarette 10 of the prior art has a generally cylindrical shape, extending along a longitudinal axis indicated by dashed line LA, and comprising two main components, namely a body 20 (device section) and a cartomizer 30 (aerosol provision component). The cartomizer includes an internal chamber containing a reservoir of a source liquid comprising a liquid formulation from which an aerosol is to be generated, a heating element, and a liquid transport element (in this example a wicking element) for transporting source liquid to the vicinity of the heating element. In some example implementations of an aerosol provision component according to embodiments of the present disclosure, the heating element may itself provide the liquid transport function. For example, the heating element and the element providing the liquid transport function may sometimes be collectively referred to as an aerosol generator/aerosol generating member/vaporizer/atomizer/distiller. The cartomizer 30 further includes a mouthpiece 35 having an opening through which a user may inhale the aerosol from the aerosol generator. The source liquid may be of a conventional kind used in e-cigarettes, for example comprising 0 to 5% nicotine dissolved in a solvent comprising glycerol, water, and/or propylene glycol. The source liquid may also comprise flavorings. The reservoir for the source liquid may comprise a porous matrix or any other structure within a housing for retaining the source liquid until such time that it is required to be delivered to the aerosol generator/vaporizer. In some examples the reservoir may comprise a housing defining a chamber containing free liquid (i.e. there may not be a porous matrix).

As discussed further below, the body 20 includes a re-chargeable cell or battery to provide power for the e-cigarette 10 and a circuit board including control circuitry for generally controlling the e-cigarette. In active use, i.e. when the heating element receives power from the battery, as controlled by the control circuitry, the heating element vaporizes source liquid in the vicinity of the heating element to generate an aerosol. The aerosol is inhaled by a user through the opening in the mouthpiece. During user inhalation the aerosol is carried from the aerosol source to the mouthpiece opening along an air channel that connects between them.

In the examples of the prior art, the body 20 and cartomizer 30 are detachable from one another by separating in a direction parallel to the longitudinal axis LA, as shown in FIG. 1, but are joined together when the device 10 is in use by a connection, indicated schematically in FIG. 1 as 25A and 25B, to provide mechanical and electrical connectivity between the body 20 and the cartomizer 30. The electrical connector on the body 20 that is used to connect to the cartomizer also serves as a socket for connecting a charging device (not shown) when the body is detached from the cartomizer 30. The other end of the charging device can be plugged into an external power supply, for example a USB socket, to charge or to re-charge the cell/battery in the body 20 of the e-cigarette. In other implementations, a cable may be provided for direct connection between the electrical connector on the body and the external power supply and/or the device may be provided with a separate charging port, for example a port conforming to one of the USB formats.

The e-cigarette 10 is provided with one or more holes (not shown in FIG. 1) for air inlet. These holes connect to an air passage (airflow path) running through the e-cigarette 10 to the mouthpiece 35. Typically the air path through such devices is relatively convoluted in that it has to pass various components and/or take multiple turns following entry into the e-cigarette. The air passage includes a region around the aerosol source and a section comprising an air channel connecting from the aerosol source to the opening in the mouthpiece.

When a user inhales through the mouthpiece 35, air is drawn into this air passage through the one or more air inlet holes, which are suitably located on the outside of the e-cigarette. This airflow (or the associated change in pressure) is detected by an airflow sensor 215, in this case a pressure sensor, for detecting airflow in electronic cigarette 10 and outputting corresponding airflow detection signals to the control circuitry. The airflow sensor 560 may operate in accordance with conventional techniques in terms of how it is arranged within the electronic cigarette to generate airflow detection signals indicating when there is a flow of air through the electronic cigarette (e.g. when a user inhales or blows on the mouthpiece).

When a user inhales (sucks/puffs) on the mouthpiece in use, the airflow passes through the air passage (airflow path) through the electronic cigarette and combines/mixes with the vapor in the region around the aerosol source to generate the aerosol. The resulting combination of airflow and vapor continues along the airflow path connecting from the aerosol source to the mouthpiece for inhalation by a user. The cartomizer 30 may be detached from the body 20 and disposed of when the supply of source liquid is exhausted (and replaced with another cartomizer if so desired). Alternatively, the cartomizer may be refillable.

In accordance with some example embodiments of the present disclosure, whilst the operation of the aerosol provision system may function broadly in line with that described above for exemplary prior art devices, e.g. activation of a heater to vaporize a source material so as to entrain an aerosol in a passing airflow which is then inhaled, the construction of the aerosol provision system of some example embodiments of the present disclosure is different to prior art devices.

Figure 2:
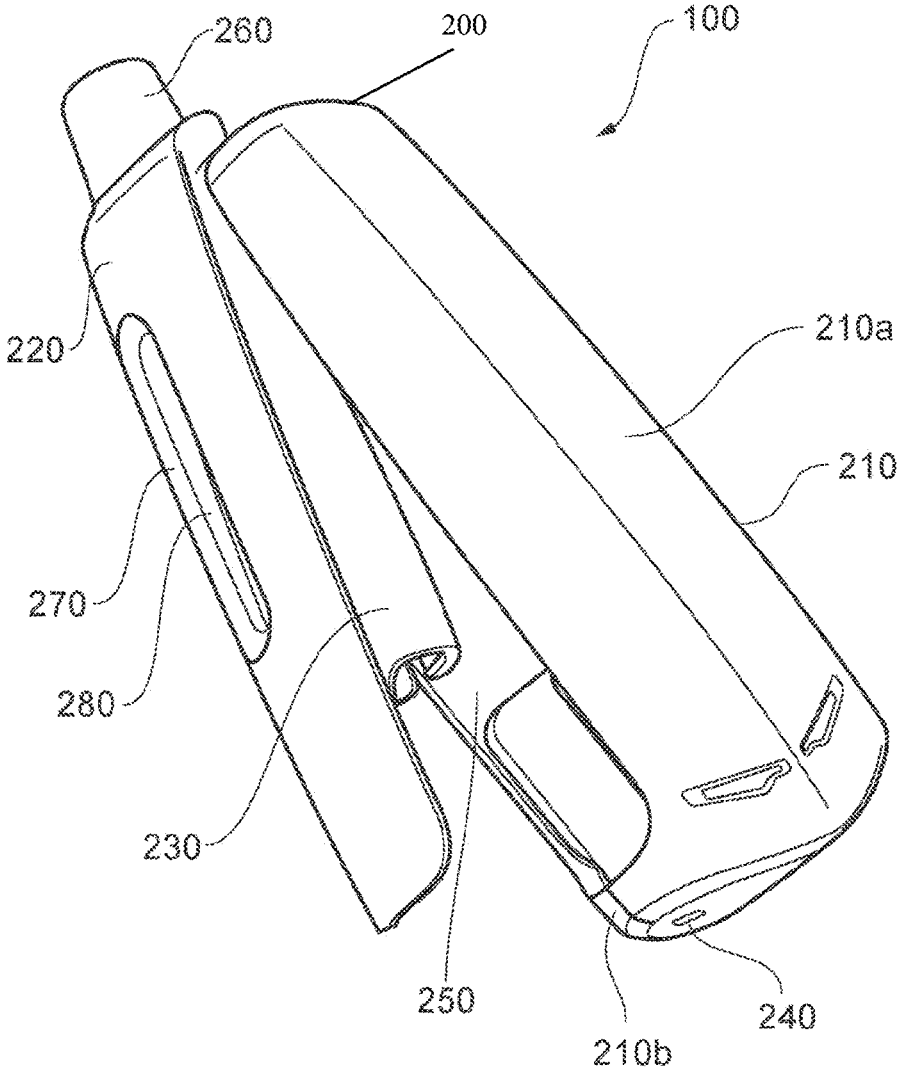
FIG. 2 shows an exemplary aerosol provision device according to the present disclosure.

In this regard, an electronic aerosol provision device is provided, wherein the device comprises a housing for receipt of an aerosol generating component, the housing comprising an air inlet and an aerosol outlet, wherein the device is configured to induce a reduction in the temperature of an aerosol when exiting the air inlet. For example, and with reference to FIG. 2, said housing is generally formed of a chassis section and a hatch section, wherein the hatch section is connected to the chassis section and moveable between a first position where the chassis section and hatch section together define an enclosed space for an aerosol generating component to be located for aerosol generation, and a second position wherein the chassis section and hatch section are spaced so as to provide access to the space. FIG. 2 is a diagram of an exemplary device 100 according to one embodiment of the present disclosure. Note that various components and details of the body, e.g. such as wiring and more complex shaping, have been omitted from FIG. 2 for reasons of clarity. Device 100 comprises a housing 200 formed by chassis section 210 and hatch section 220. Chassis section 210 may take the form of a single piece of material, or may be formed from two separate pieces of material 210*a*, 210*b* joined together along an appropriate seam (not shown). Chassis section 210 and hatch section 220 are connected such that hatch section 220 is moveable relative to the chassis section 210 between a first position where the chassis section 210 and hatch section 220 together define an enclosed space 250 for an aerosol generating component (not shown) to be located for aerosol generation, and a second position wherein the chassis section 210 and hatch section 220 are spaced so as to provide access to the space 250. FIG. 2 shows chassis section 210 and hatch section 220 in the second position with space 250 being accessible. As can also be seen in FIG. 2, in some embodiments, the hatch section 220 may comprise a sleeve 230 mounted on an internal wall of the hatch section 220 such that the sleeve projects towards the space 250. Sleeve 230 defines a generally longitudinal recess which is able to accommodate an aerosol generating component (not shown). More specifically, an aerosol generating component can be inserted into sleeve 230. Sleeve 230 will be explained in further detail below; however, in the context of the embodiment of FIG. 2, it will be apparent than when the hatch section 220 is moved to the first position such that, together with the chassis section 210, an enclosed space 250 is formed, the sleeve 230 (and the aerosol generating component if present) will occupy the space 250.

The hatch section 220 of the device 100 shown in FIG. 2 may also comprise a mouthpiece 260 which defines the aerosol outlet. Additionally, the device 100 generally includes an air inlet 240 which facilitates the inlet of air into the space 250. The inlet 240, space 250 and outlet 260 together form a fluidly connected pathway for air to flow from outside the device, through the space 250, and out of the aerosol outlet of the mouthpiece. When an aerosol generating component is present in the space 250, the air flow will be channeled through (or past) the aerosol generating component thereby facilitating the entrainment of aerosol in the airflow path.

As explained above with respect to devices of the prior art, the device 100 of some example embodiments of the present disclosure can be activated by any suitable means. Such suitable activation means include button activation, or activation via a sensor (touch sensor, airflow sensor, pressure sensor, thermistor etc.). By activation, it is meant that the aerosol generator of the aerosol generating component can be energized such that vapor is produced from the source material. In this regard, activation can be considered to be distinct from actuation, whereby the device 100 is brought from an essentially dormant or off state, to a state in which once or more functions can be performed on the device and/or the device can be placed into a mode which can be suitable for activation.

In this regard, housing 200 generally comprises a power supply/source (not shown in FIG. 2) which supplies power to an aerosol generator of the aerosol generating component. It is noted that the connection between the aerosol generating component and the power supply may be wired or wireless. For example, where the connection is a wired connection, contacts 450 within the housing 200, for example on the chassis section 210, may contact with corresponding electrodes of the aerosol generating component when the hatch section 220 is in the first position and the aerosol generating component thus resides within space 250. The establishment of such contact will be explained further below. Alternatively, it is possible for the connection between the power source and the aerosol generating component to be wireless in the sense that a drive coil (not shown) present in the housing 200 and connected to the power source could be energized such that a magnetic field is produced. The aerosol generating component could then comprise a susceptor which is penetrated by the magnetic field such that eddy currents are induced in the susceptor and it is heated.

It has been found following extensive investigations by the present inventors that users of electronic aerosol provision systems, such as e-cigarettes, may, from time to time, exhale back into system. When the exhalant contains aerosol which has been formed from the condensation of a heat-generated vapor, this "exhaled aerosol" can still be of a relatively high temperature. Further, there can be residual "system aerosol" that resides in the system which can also still be of a relatively high temperature. Depending on the design of the system, the exhaled aerosol, the system aerosol, or a combination of the two, can be forced out of the air inlet through which incoming air was initially drawn. Due to the relatively high temperature of this exiting aerosol, it is possible that it could impact a user's skin and be unpleasant. This might particularly be the case where the air inlet is positioned on the system adjacent to a location by which the user will hold the system (a "holding location"). For larger aerosol provisions systems, it is more likely that the air inlet will be placed in a location away from a holding location (or at the very least there may be more freedom as to where the user can hold the device). More compact aerosol provisions systems, however, will have fewer locations in which to place the air inlet. As a result, there is a greater likelihood of hot exiting aerosol impacting a user and causing discomfort. The present inventors have recognized this problem and have devised the present invention accordingly.

In the context of the present disclosure, "exhalant aerosol" is considered to be aerosol that has been generated by the aerosol provision system, inhaled/consumed by the user, and subsequently exhaled into the system.

In the context of the present disclosure, "system aerosol" is considered to be aerosol that has been generated by the aerosol provision system and which has not left the system.

In the context of the present disclosure, "exiting aerosol" is considered to be aerosol that has been forced through the air inlet. Exiting aerosol can be exhalant aerosol, system aerosol, or a combination thereof.

In the context of the present disclosure, an aerosol provision system is a system that comprises an aerosol provision device and an aerosol generating component. The aerosol provision device typically contains a power source, such as a battery, and control electronics which direct power to be delivered to the aerosol generating component following an actuation signal such that aerosol can be generated. In some embodiments, the aerosol provision device and aerosol generating component are formed as a single component. In some embodiments, the aerosol provision device and aerosol generating component are separate components which can be engaged together so as to facilitate aerosol generation.

The aerosol provision system comprises an aerosol generating means, such as a heater etc. The aerosol generating means can be located in either the aerosol provision device or the aerosol generating component. In some embodiments, an aerosol generating means can be located in both the aerosol provision device and the aerosol generating component.

The aerosol generating component either comprises a substrate from which an aerosol can be produced, or contains an area for receipt of such a substrate. For example, the aerosol generating component can take the form of a "tank", "cartomizer" or "pod" comprising an area for receipt of a substrate. The area for receipt of the substrate may be accessible to the user for replenishing depleted substrate. Alternatively, the area for receipt of such a substrate may not be accessible to the user without destruction of the aerosol generating component.

In some embodiments, the aerosol generating component may not comprise the aerosol generating means. In these embodiments, the aerosol generating means is generally present on the device and, upon engagement of between the aerosol generating component and the aerosol provision device, the aerosol generating means is brought into sufficient proximity with the substrate such that it can be transformed into an aerosol as appropriate.

Whilst not a critical aspect of embodiments of the present disclosure, a suitable aerosol generating component for positioning within space 250 will now be described in general. The aerosol generating component includes an aerosol generator arranged in an air passage extending along a generally longitudinal axis of the aerosol generating component. The aerosol generator may comprise a resistive heating element adjacent a wicking element (liquid transport element) which is arranged to transport source liquid from a reservoir of source liquid within the aerosol generating component to the vicinity of the heating element for heating. The reservoir of source liquid in this example is adjacent to the air passage and may be implemented, for example, by providing cotton or foam soaked in source liquid. Ends of the wicking element are in contact with the source liquid in the reservoir so that the liquid is drawn along the wicking element to locations adjacent the extent of the heating element. The general configuration of the wicking element and the heating element may follow conventional techniques. For example, in some implementations the wicking element and the heating element may comprise separate elements, e.g. a metal heating wire wound around/wrapped over a cylindrical wick, the wick, for instance, consisting of a bundle, thread or yarn of glass fibers. In other implementations, the functionality of the wicking element and the heating element may be provided by a single element. That is to say, the heating element itself may provide the wicking function. Thus, in various example implementations, the heating element/wicking element may comprise one or more of: a metal composite structure, such as porous sintered metal fiber media (Bekipor® ST) from Bekaert, a metal foam structure, e.g. of the kind available from Mitsubishi Materials; a multi-layer sintered metal wire mesh, or a folded single-layer metal wire mesh, such as from Bopp; a metal braid; or glass-fiber or carbon-fiber tissue entwined with metal wires. The "metal" may be any metallic material having an appropriate electric resistivity to be used in connection/combination with a battery. The resultant electric resistance of the heating element will typically be in the range 0.5-5 Ohm. Values below 0.5 Ohm could be used but could potentially overstress the battery. The "metal" could, for example, be a NiCr alloy (e.g. NiCr8020) or a FeCrAl alloy (e.g. "Kanthal") or stainless steel (e.g. AISI 304 or AISI 316).

Figure 2A:
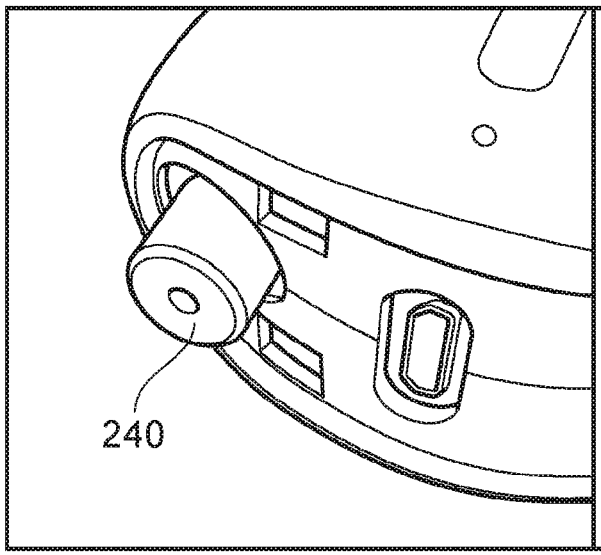
FIGS. 2*a* and 2*b* show respectively an air inlet according to the prior art and an air inlet according to the present disclosure.
Figure 2B:
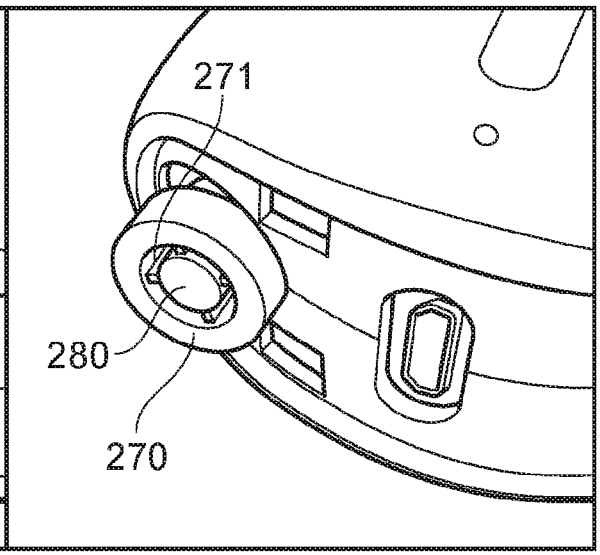

The air inlet 240 of the present embodiment will now be described in more detail. FIG. 2*a* shows a conventional air inlet 240. Air inlet 240 is generally a conventional circular aperture in the housing of the device. Air inlet 240 connects to aerosol outlet 260 and provides a flow path through the device. Typically, an aerosol generating component is positioned between air inlet 240 and aerosol outlet 260 such that air flowing into the device through the air inlet 240 reaches the aerosol generating component. Aerosol generated from the aerosol generating component then flows onwards to the aerosol outlet 260 at which point it can be inhaled by the user. FIG. 2*b* shows an air inlet 270 according to the present embodiment. Air inlet 270 comprises an aperture 271 with at least one fixed obstruction 280 which extends at least partially across the aperture 271 without fully preventing airflow through the aperture 271.

Figure 3A:
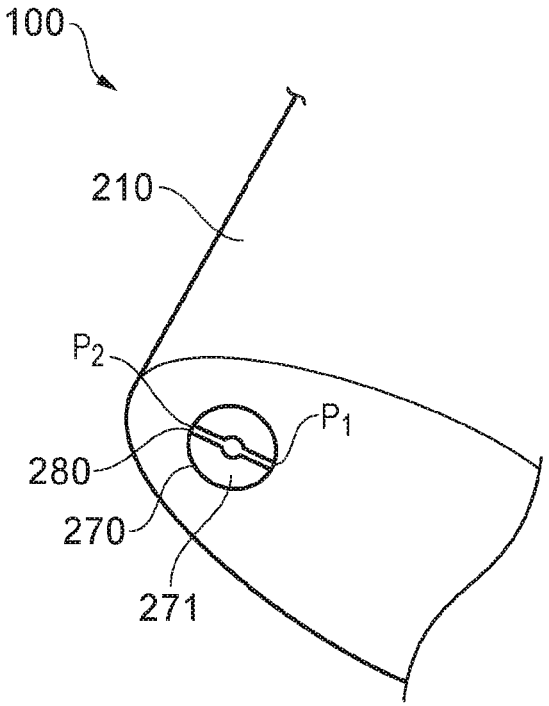
FIGS. 3*a* and 3*b* show air inlets according to the present disclosure.

FIG. 3*a* shows an enlarged image of the distal end of device 100, showing air inlet 270. Aperture 271 of air inlet 270 is shown as being circular, but can take any shape, for example, circular, triangular, square, or polygonal. Aperture 271 has a maximum opening width which is the largest linear extent between two points on an edge of the aperture. In one embodiment, the aperture 271 has a maximum opening width that is less than the maximum opening width of the aerosol outlet 260.

The at least one fixed obstruction 280 can take the form of a strut that extends from a point P1 on the edge of aperture 271 into the aperture 271. In one embodiment, the at least one fixed obstruction 280 extends from one point P1 on the edge of aperture 271 to another point P2 on the edge of the aperture forming an obstruction across the aperture 271. It will be appreciated that fixed obstruction 280 can take various forms depending on the number of points of attachment P with the edge of the aperture 271. In this regard, the number of points of attachment may be represented by Pn, where n is the number of separate points of attachment on the edge of the aperture 271. Pn may be selected from 1, 2, 3, 4, 5, 6 or more. Furthermore, the number of fixed obstructions may also be represented by Fz, where if z=1 there is one fixed obstruction. Fz can be selected from 1, 2, 3, 4 or more. In one embodiment, z is 1 and n is 1, 2 3, 4 or 5.

Figure 3B:
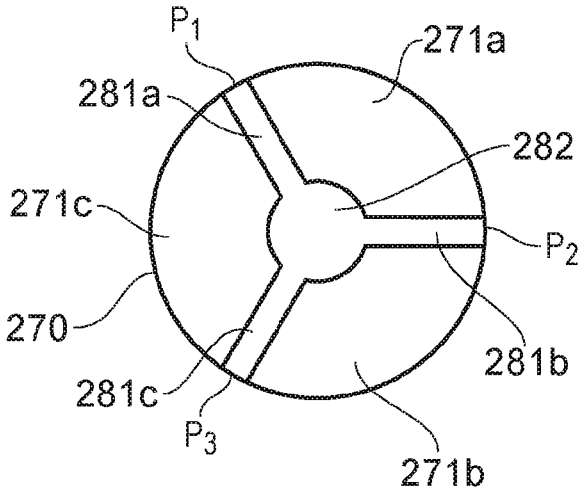
Figure 4A:
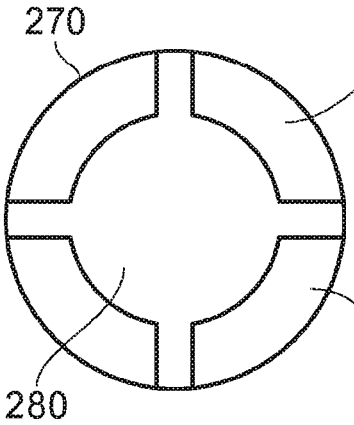
FIGS. 4*a* to 4*d* show air inlets according to the present disclosure.
Figure 4B:
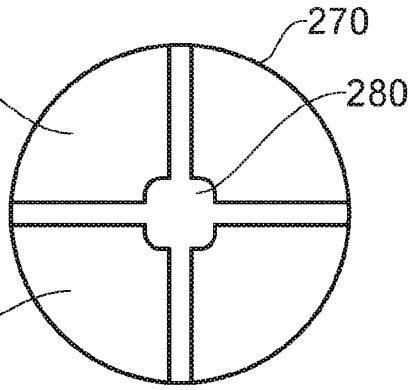
Figure 4C:
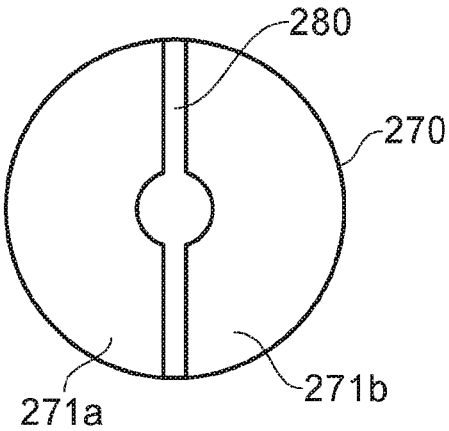
Figure 4D:
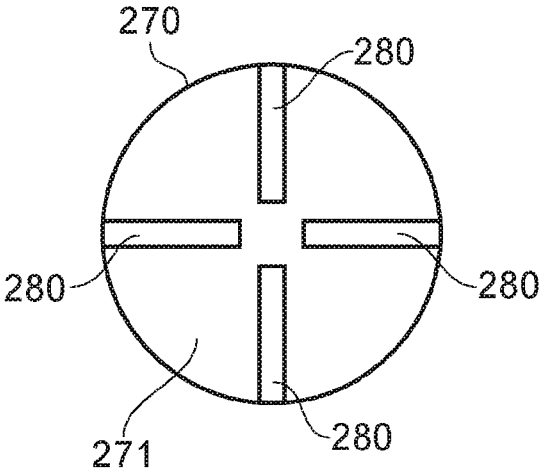

In one embodiment, as shown in FIG. 3*b*, z is 1 and n is 3. As will be appreciated, where z is 1 and n is 3, a single fixed obstruction will span aperture 271 but be attached to the edge of aperture 271 at three points. In this embodiment, fixed obstruction can be considered to comprise three connecting arms 281*a,b,c* and one connecting region 282. Thus, the number of connecting arms generally corresponds to n. Connecting region 282 is that area of the fixed obstruction that is generally equidistant from each point of attachment P. As a result, when there are three or more points of attachment, connecting region 282 is generally located in the center of aperture 271. Connecting region can take any shape, for example, circular, triangular, square, or polygonal. In one embodiment, connecting region takes a shape similar to that of aperture 271. The size of connecting region 282 can generally be varied from system to system so as to vary the extent to which aperture 271 is covered by the fixed obstruction. In this regard, where a fixed obstruction is attached at a plurality of attachment points, a plurality of exit regions 271*a,b,c* will be created. By varying the number of attachment points and the size of the connecting region, it is possible to vary the size of the exit regions 271*a,b,c* and by analogy the area of impact experienced by the exit aerosol. For example, and as shown in FIGS. 4*a* to 4*d*, various numbers and sizes of exit regions can be created so as to adjusted the extent to which exiting aerosol is reduced in temperature. FIG. 4*a* shows an air inlet 270 with four exit regions of comparatively smaller size compared to those shown in FIG. 4*b*. FIG. 4*c* shows an air inlet 270 comprising a fixed obstruction dividing the aperture 271 into two regions 271*a* and 271*b*. FIG. 4*d* shows an example of an air inlet 270 having four separate fixed obstructions extending partially across aperture 271.

The result of fixed obstruction 280 extending at least partially across aperture 271 is that exiting aerosol is presented with an obstruction upon exiting the device. Without being bound in this regard, this obstruction serves to decrease the energy of the exiting aerosol as it leaves the device. The temperature of the aerosol is reduced as a result, and the likelihood of the user being impacted by aerosol with an unpleasantly high temperature is reduced.

In one embodiment, the at least one fixed obstruction is configured to reduce the temperature of the exiting aerosol by about 5° C. or more, about 10° C. or more, about 15° C. or more, about 20° C. or more, about 25° C. or more, about 30° C. or more, about 35° C. or more, about 40° C. or more, about 45° C. or more, or about 50° C. or more. In one embodiment, the at least one fixed obstruction is configured to reduce the temperature of the exiting aerosol to below about 140° C., below about 135° C., below about 130° C., below about 125° C., below about 120° C., below about 125° C., below about 120° C., below about 115° C., below about 110° C., below about 105° C., below about 100° C., below about 95° C., below about 90° C., below about 85° C., or below about 80° C.

The use of the at least one fixed obstruction is generally applicable across a range of aerosol provision systems. However, in some embodiments, an uninterrupted linear pathway exists between the air inlet and the aerosol outlet. Without being bound in this regard, since in these embodiments at least a portion of the exhalant aerosol and the system aerosol (or both) may be able to travel from the aerosol outlet to the air inlet without obstruction, such aerosol may have relatively higher energy than exhalant aerosol/system aerosol that has had to undergo a tortuous path to reach the air inlet. Therefore, in these embodiments, the need for aerosol cooling may be greater. If an aerosol generating component is located between the air inlet and the aerosol outlet of the device, the aerosol generating component will have a corresponding air inlet which connects with the air inlet on the device and a corresponding aerosol outlet which connects with the aerosol outlet on the device to maintain/provide the presence of an uninterrupted linear pathway between the air inlet and the aerosol outlet. If an aerosol generating cartridge is engaged to the aerosol outlet of the device, the aerosol generating component will have an air inlet which connects with the aerosol outlet on the device such that the aerosol outlet of the aerosol generating component serves to function as the aerosol outlet for the system. In such embodiments, the air inlet and aerosol outlet on the aerosol generating component maintain the presence of an uninterrupted linear pathway between the air inlet and the aerosol outlet of the system. It will be appreciated that it is possible for the heater of the aerosol generating component to be located in the airflow path and yet there still be an uninterrupted linear pathway between the air inlet and the aerosol outlet of the system. For example, the uninterrupted linear pathway between the air inlet and the aerosol outlet of the system could pass alongside the heater.

In a further embodiment, an uninterrupted linear pathway exists between the distal most portion of the heater located in the aerosol provision system and the air inlet. Further, in some embodiments, the device housing comprises an air inlet and an aerosol outlet, wherein the air inlet is at distal end of the device housing and the aerosol outlet is at a proximal end of the device housing, wherein a ratio of from 1:2 to 1:1 exists between the length of the flow path between the air inlet and the aerosol outlet, and the total length of the system. Without being bound in this regard, since in these embodiments the flow path between the air inlet and the aerosol outlet accounts for at least half of the total length of the system, exhalant aerosol/system aerosol may have a relatively short distance to travel before being expelled from the device. As a result, such aerosol may not have cooled as much by the time it reaches the air inlet. Therefore, in these embodiments, the need for aerosol cooling may be greater.

In one embodiment, the ratio between the length of the flow path between the air inlet and the aerosol outlet, and the total length of the system, is from 1:2 to 1:1, from 2:3 to 1:1, from 3:4 to 1:1, or from 4:5 to 1:1.

The present disclosure will now be further describe with reference to the following non-limiting examples.

EXAMPLES

An aerosol delivery system comprising an electronic aerosol provision device and aerosol generating component was used to assess the temperature of aerosol exiting from the air inlet (exhalant aerosol). As shown in FIG. 2*a*, a comparative device utilized an air inlet (2.1 mm in diameter) with no fixed obstruction extending at least partially across the aperture. The temperature of the aerosol exiting the air inlet was found to be approximately 140° C. (measured by placing a thermistor in a linear flow path about 1 cm from the aperture).

FIG. 2*b* shows the same system as used in FIG. 2*a*, with the exception that the air inlet was modified to include a fixed obstruction extending at least partially across the aperture.

Figure 5A:
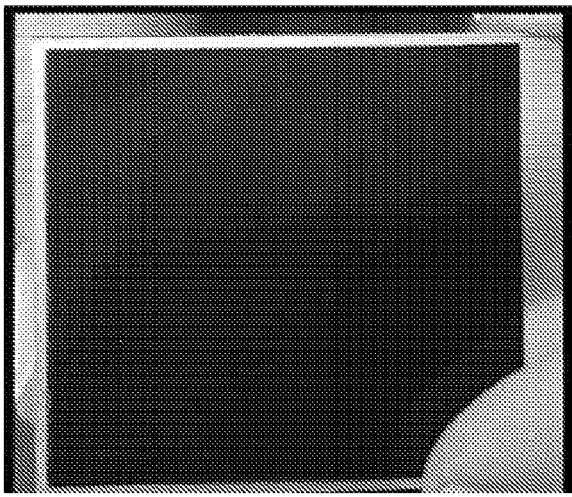
FIGS. 5*a* to 5*i* show temperature measurements for aerosol exiting an air inlet of a conventional air inlet.
Figure 5B:
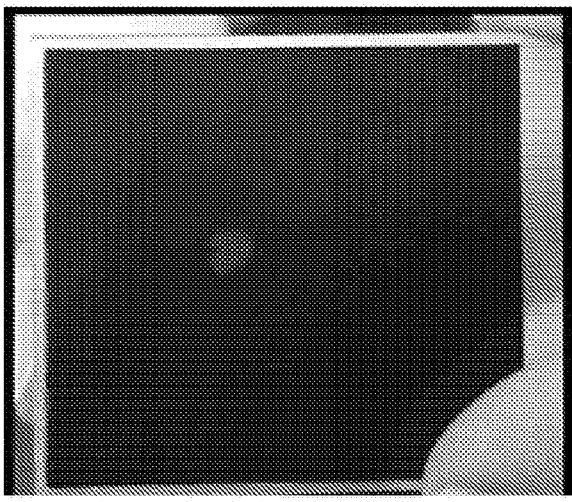
Figure 5C:
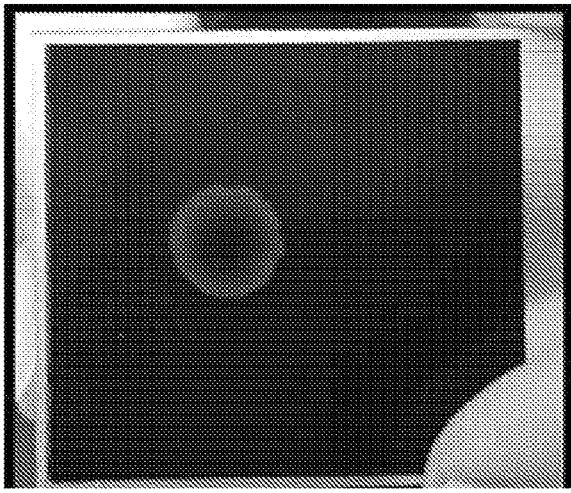
Figure 5D:
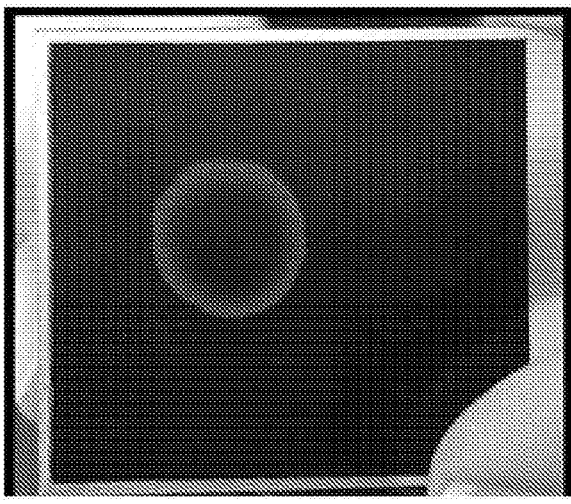
Figure 5E:
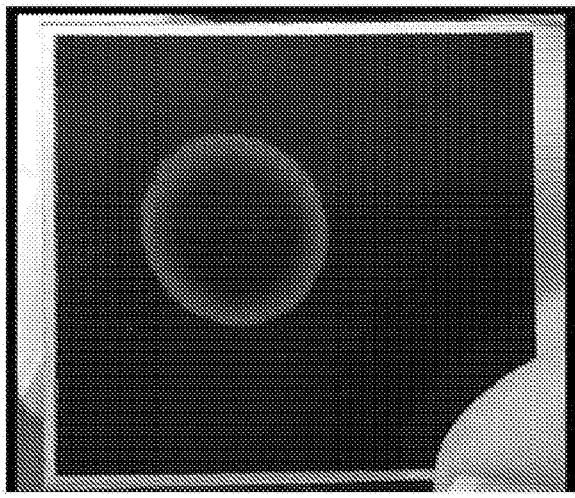
Figure 5F:
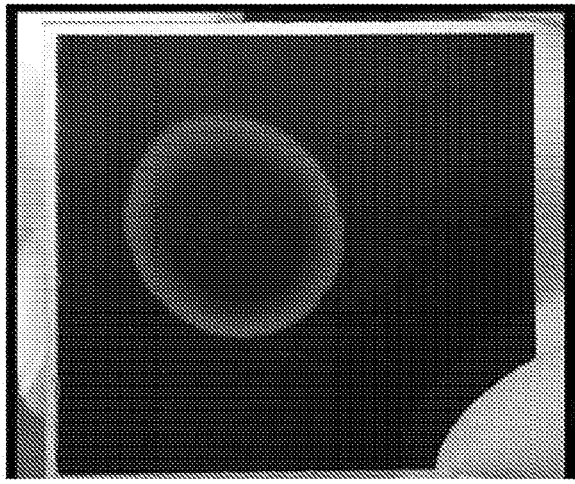
Figure 5G:
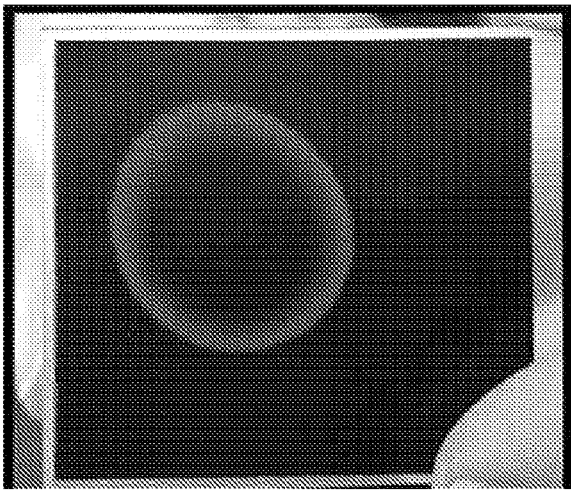
Figure 5H:
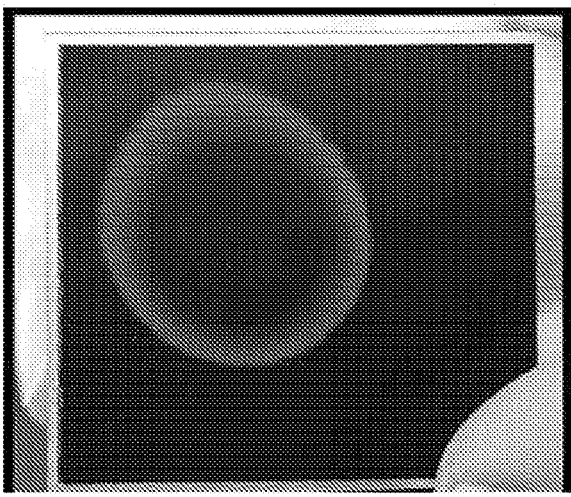
Figure 5I:
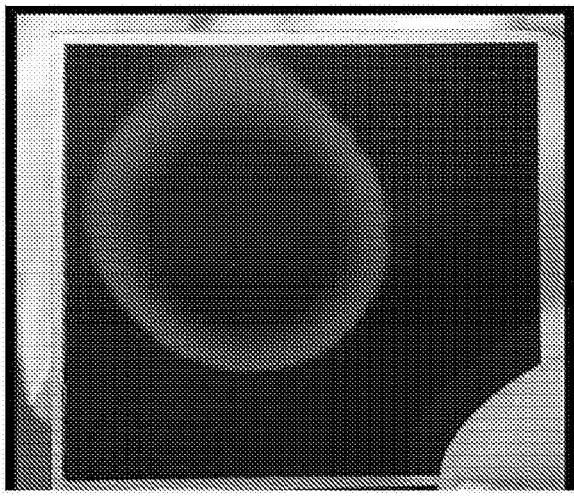

Using a sheet of brass with a liquid crystal thermochromic film, it is possible to visualize the representative temperature that might be felt by a user on their skin if it were to be placed in line with the aperture. The sheet of brass with a liquid crystal thermochromic film has a temperature range of from 40° C. (red) through to 45° C. (blue). Temperatures beyond this revert to black. FIGS. 5*a* to 5*i* show the temperature evolution over time (FIG. 5*a* representing the temperature at 0 s, FIG. 5*b* representing the temperature at 0.25 s, FIG. 5*c* representing the temperature at 0.5 s, FIG. 5*d* representing the temperature at 0.75 s, FIG. 5*e* representing the temperature at 1.0 s, FIG. 5*f* representing the temperature at 1.25 s, FIG. 5*g* representing the temperature at 1.5 s, FIG. 5*h* representing the temperature at 1.75 s, FIG. 5*i* representing the temperature at 2 s).

Figure 6A:
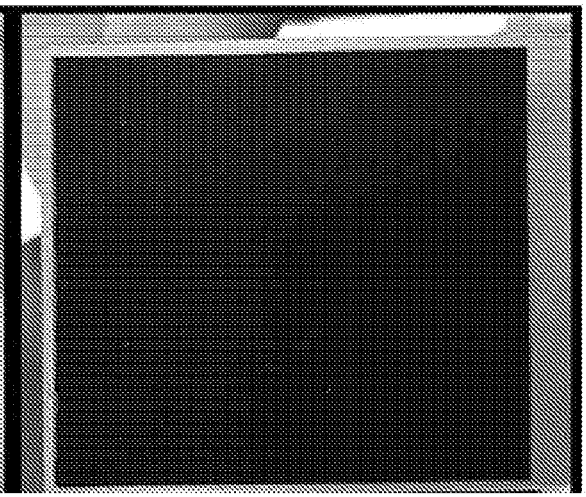
FIGS. 6*a* to 6*i* show temperature measurements for aerosol exiting an air inlet according to the present disclosure.
Figure 6B:
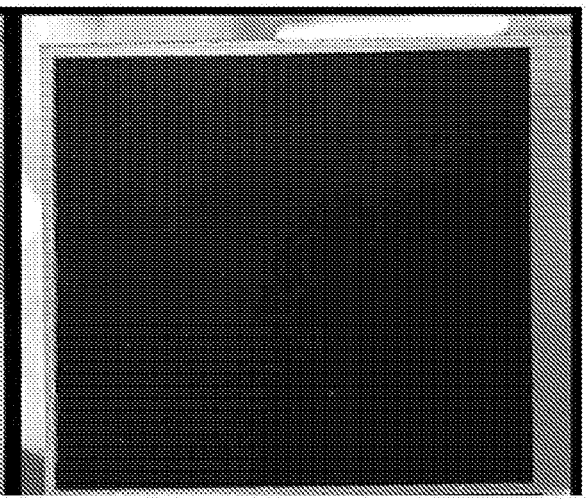
Figure 6C:
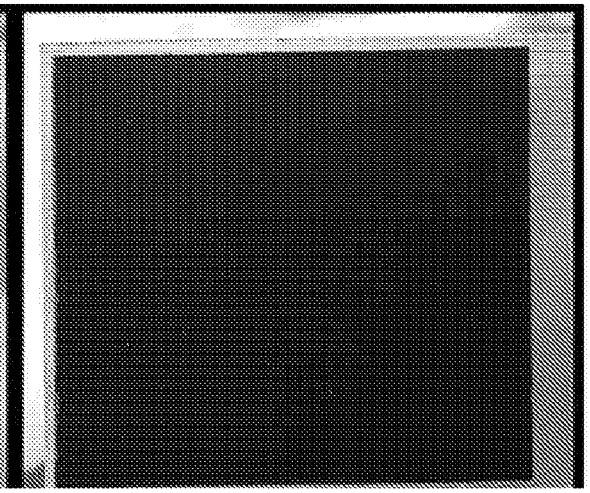
Figure 6D:
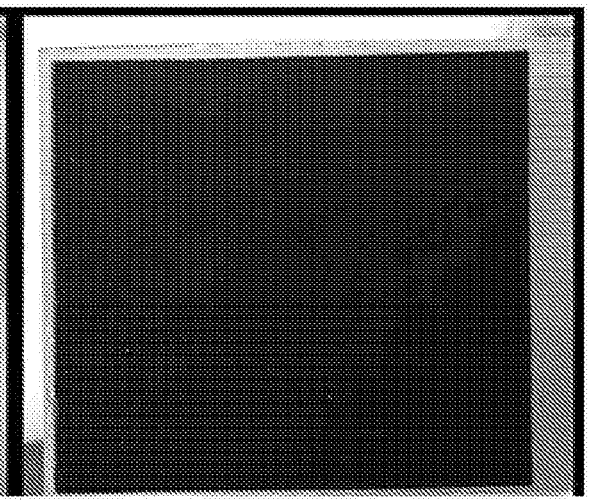
Figure 6E:
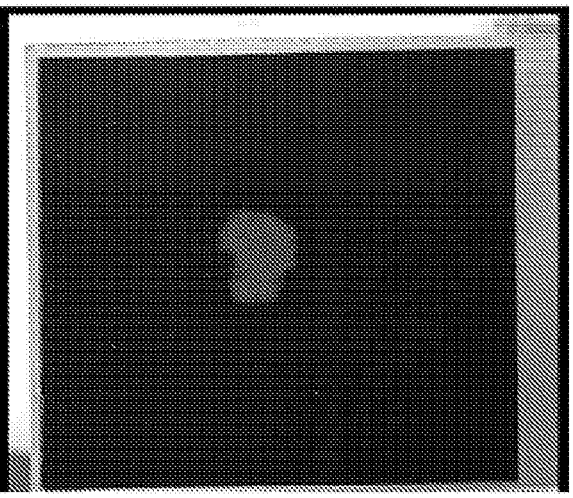
Figure 6F:
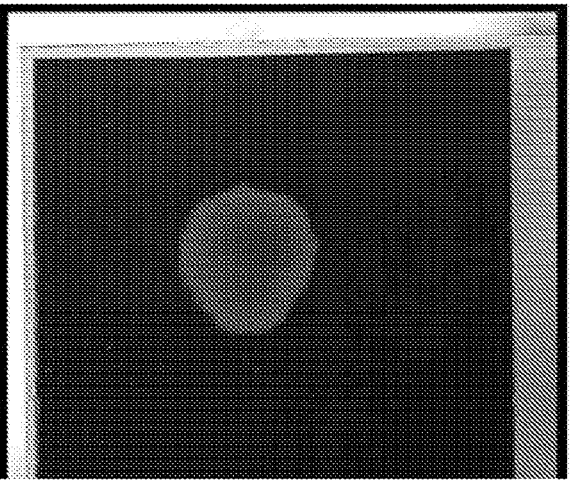
Figure 6G:
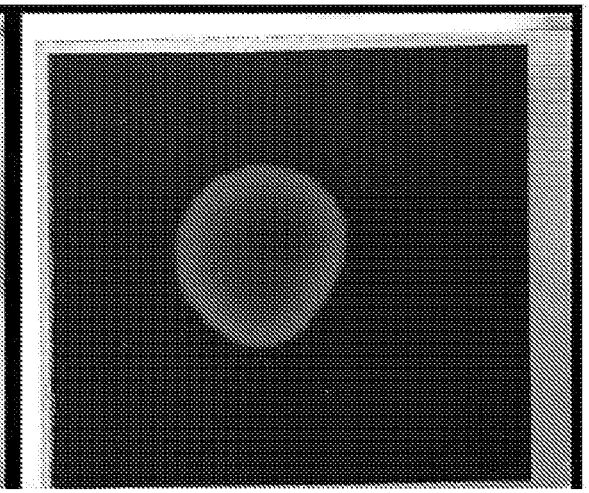
Figure 6H:
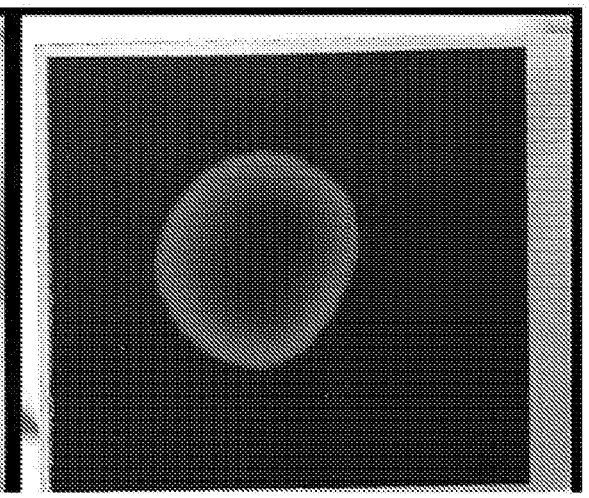
Figure 6I:
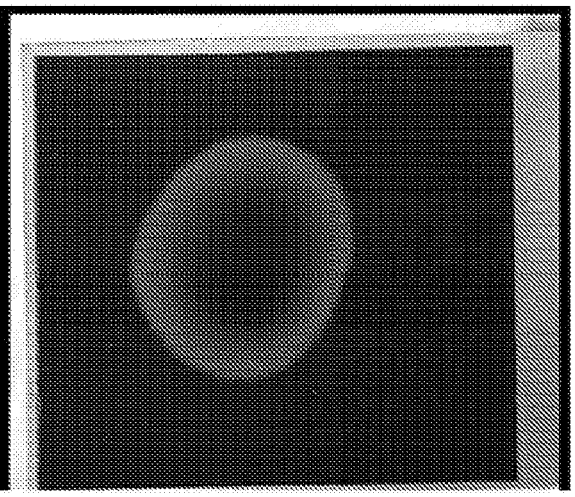

As can be seen from the images in FIGS. 5*a* to 5*i*, the temperature evolution resulting from aerosol exiting a conventional air inlet and impacting the sheet of brass is rapid and gets above 45° C. within 1.0 seconds (indicated by the fact that the thermochromic film has transitioned from black, through red to blue and then back to black). By contrast, when using identical conditions except for the use of an air inlet according to the present invention, FIGS. 6*a* to 6*i* show that the temperature evolution is much slower. Indeed, the temperature does not rise above 40° C. until 1.25 seconds and does not rise above 45° C. until beyond 1.75 seconds when a darkening of the thermochromic film can first be detected. (FIG. 6*a* representing the temperature at 0 s, FIG. 6*b* representing the temperature at 0.25 s, FIG. 6*c* representing the temperature at 0.5 s, FIG. 6*d* representing the temperature at 0.75 s, FIG. 6*e* representing the temperature at 1.0 s, FIG. 6*f* representing the temperature at 1.25 s, FIG. 6*g* representing the temperature at 1.5 s, FIG. 6*h* representing the temperature at 1.75 s, FIG. 6*i* representing the temperature at 2 s).

This shows that the air inlet according to the present disclosure is able to reduce the temperature of an aerosol exiting from the device air inlet. Thus, that the air inlet according to the present disclosure is able to reduce the likelihood that a user will experience an unpleasant experience due to relatively hot aerosol impacting their skin.

In addition to measuring the temperature evolution, the peak temperature of each exiting aerosol was also tested using a thermocouple in the direct path of the hot jet. The conventional air inlet peaked at approximately 140° C. The air inlet according to the present disclosure peaked at approximately 85° C. This is a significant reduction.

In order to address various issues and advance the art, this disclosure shows by way of illustration various embodiments in which the claimed invention(s) may be practiced. The advantages and features of the disclosure are of a representative sample of embodiments only, and are not exhaustive and/or exclusive. They are presented only to assist in understanding and to teach the claimed invention(s). It is to be understood that advantages, embodiments, examples, functions, features, structures, and/or other aspects of the disclosure are not to be considered limitations on the disclosure as defined by the claims or limitations on equivalents to the claims, and that other embodiments may be utilized and modifications may be made without departing from the scope of the claims. Various embodiments may suitably comprise, consist of, or consist essentially of, various combinations of the disclosed elements, components, features, parts, steps, means, etc. other than those specifically described herein, and it will thus be appreciated that features of the dependent claims may be combined with features of the independent claims in combinations other than those explicitly set out in the claims. The disclosure may include other inventions not presently claimed, but which may be claimed in future.

The invention claimed is:

1. An electronic aerosol provision device, the device comprising:

a housing for receipt of an aerosol generating component, the housing comprising an air inlet and an aerosol outlet, wherein the electronic aerosol provision device is configured to induce a reduction in the temperature of an aerosol when exiting the air inlet, wherein the air inlet defines an aperture with at least one fixed obstruction which extends at least partially across the aperture without fully preventing airflow through the aperture.

2. The electronic aerosol provision device according to claim 1, wherein an uninterrupted linear pathway exists between the air inlet and the aerosol outlet.

3. The electronic aerosol provision device according to claim 2, wherein a chamber for receiving an aerosol generating component is arranged in the pathway between the air inlet and the aerosol outlet.

4. The electronic aerosol provision device according to claim 1, wherein the aerosol outlet forms part of a mouthpiece.

5. The electronic aerosol provision device according to claim 1, wherein the at least one fixed obstruction extends from a point of attachment on an edge of the aperture.

6. The electronic aerosol provision device according to claim 5, wherein the at least one fixed obstruction extends from a point of attachment on an edge of the aperture to another point of attachment on the edge of the aperture.

7. The electronic aerosol provision device according to claim 5, wherein the number of points of attachment of the at least one fixed obstruction is one of 1, 2, 3, 4, 5, or 6.

8. The electronic aerosol provision device according to claim 7, wherein the number of points of attachment is 3.

9. The electronic aerosol provision device according to claim 5, wherein the at least one fixed obstruction comprises a single fixed obstruction.

10. The electronic aerosol provision device according to claim 1, wherein the device is configured to reduce the temperature of the aerosol exiting the air inlet by about 5° C. or more.

11. The electronic aerosol provision device according to claim 1, wherein the device is configured to reduce the temperature of the aerosol exiting the air inlet to below about 140° C.

12. The electronic aerosol provision device according to claim 1, wherein the air inlet is at distal end of the device housing and the aerosol outlet is at a proximal end of the device housing, wherein a ratio of from about 1:2 to about 1:1 exists between the length of the flow path between the air inlet and the aerosol outlet, and the total length of the device.

13. The electronic aerosol provision device according to claim 12, wherein the ratio is from about 2:3 to 1:1.

14. An electronic aerosol provision system including the electronic aerosol provision device according to claim 1, wherein the aerosol generating component comprises an aerosol generating substrate.

15. The electronic aerosol provision system according to claim 14, wherein the substrate is a liquid.

16. The electronic aerosol provision system according to claim 14, wherein the aerosol generating component is located between the air inlet and the aerosol outlet of the device.

17. The electronic aerosol provision system according to claim 16, wherein the air inlet of the aerosol generating component connects with the air inlet on the device and the aerosol outlet aerosol generating component connects with the aerosol outlet on the device to provide an uninterrupted linear pathway between the air inlet and the aerosol outlet of the system.

18. The electronic aerosol provision system according to claim 14, wherein an aerosol generating component is engaged to the aerosol outlet of the device.

19. The electronic aerosol provision system according to claim 18, wherein the air inlet of the aerosol generating component connects with the aerosol outlet on the device such that the aerosol outlet of the aerosol generating component serves to function as the aerosol outlet for the system, so as to provide the presence of an uninterrupted linear pathway between the air inlet and the aerosol outlet of the system.

* * * * *